US010844526B2

(12) United States Patent
Brinkman et al.

(10) Patent No.: US 10,844,526 B2
(45) Date of Patent: Nov. 24, 2020

(54) UPPER INCLUDING A KNITTED COMPONENT HAVING STRUCTURES WITH APERTURES EXTENDING FROM A SURFACE

(71) Applicant: NIKE, Inc., Beaverton, OR (US)

(72) Inventors: Ashleigh S. Brinkman, Portland, OR (US); Andreas Schoppel, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 288 days.

(21) Appl. No.: 15/789,804

(22) Filed: Oct. 20, 2017

(65) Prior Publication Data

US 2018/0110283 A1 Apr. 26, 2018

Related U.S. Application Data

(60) Provisional application No. 62/411,633, filed on Oct. 23, 2016.

(51) Int. Cl.

| | |
|---|---|
| ***D04B 1/24*** | (2006.01) |
| ***A43B 1/04*** | (2006.01) |
| ***A43C 1/04*** | (2006.01) |
| ***A43B 23/02*** | (2006.01) |
| *A43B 23/04* | (2006.01) |

(52) U.S. Cl.

CPC ..... *D04B 1/24* (2013.01); *A43B 1/04* (2013.01); *A43B 23/0265* (2013.01); *A43C 1/04* (2013.01); *A43B 23/028* (2013.01); *A43B 23/042* (2013.01); *D10B 2403/0113* (2013.01); *D10B 2501/043* (2013.01); *D10B 2501/062* (2013.01)

(58) Field of Classification Search

CPC . D04B 1/108; D04B 1/24; D04B 7/30; D04B 9/42; A43B 1/104

See application file for complete search history.

(56) References Cited

U.S. PATENT DOCUMENTS

| | | | | |
|---|---|---|---|---|
| 8,631,589 | B2 * | 1/2014 | Dojan | A43C 1/04 36/45 |
| 8,973,410 | B1 * | 3/2015 | Podhajny | A43B 23/024 66/177 |
| 8,997,530 | B1 * | 4/2015 | Podhajny | A43B 1/04 66/177 |
| 9,078,488 | B1 * | 7/2015 | Meir | D04B 1/22 |
| 9,192,204 | B1 * | 11/2015 | Liles | A43B 1/04 |
| 9,301,567 | B2 * | 4/2016 | Dealey | D04B 1/123 |
| 9,445,640 | B2 | 9/2016 | Dua et al. | |
| 9,510,637 | B2 * | 12/2016 | Podhajny | A43B 1/04 |
| 9,661,892 | B2 * | 5/2017 | Meir | A43B 23/0245 |

(Continued)

*Primary Examiner* — Danny Worrell

(74) *Attorney, Agent, or Firm* — Brinks Gilson & Lione

(57) ABSTRACT

In one aspect, the present disclosure is related to an upper for an article of footwear. The upper may include a knitted component with a first yarn, the first yarn forming a plurality of intermeshed loops of the knitted component. The upper may further include a surface formed by the plurality of intermeshed loops. The upper may further include a first structure at least partially forming a first aperture, the first structure extending from the surface, the first structure having a first end and a second end adjacent to the surface, and the first structure having a central portion extending from the first end to the second end. The first structure may include the first yarn.

17 Claims, 5 Drawing Sheets

FIG. 2

(56) References Cited

U.S. PATENT DOCUMENTS 9,888,743 B2 * 2/2018 Bell ..... A43B 23/0245
10,385,485 B2 * 8/2019 Cross ..... D04B 1/24
2006/0059715 A1 * 3/2006 Aveni ..... A43B 7/08 36/45
2008/0110048 A1 * 5/2008 Dua ..... A43B 1/04 36/45
2008/0110049 A1 * 5/2008 Sokolowski ..... A43B 3/0031 36/50.1
2010/0154256 A1 * 6/2010 Dua ..... A43B 1/04 36/25 R
2010/0251564 A1 * 10/2010 Meschter ..... A43B 23/0225 36/28
2011/0041359 A1 * 2/2011 Dojan ..... A43B 23/025 36/47
2012/0246973 A1 * 10/2012 Dua ..... A43B 23/0235 36/83
2014/0130373 A1 * 5/2014 Baines ..... B29C 65/02 36/84
2014/0196311 A1 * 7/2014 Follet ..... B32B 5/26 36/45
2014/0237861 A1 * 8/2014 Podhajny ..... A43B 1/04 36/9 R
2014/0245632 A1 * 9/2014 Podhajny ..... A43B 1/04 36/45
2014/0245633 A1 * 9/2014 Podhajny ..... A43B 23/26 36/45
2014/0245634 A1 * 9/2014 Podhajny ..... D04B 1/22 36/54
2014/0338226 A1 * 11/2014 Zavala ..... D04B 1/102 36/84
2015/0059210 A1 * 3/2015 Droege ..... A43B 23/0275 36/84
2015/0250256 A1 * 9/2015 Podhajny ..... A43B 1/02 36/83
2016/0058099 A1 * 3/2016 Panian ..... A43B 23/0265 36/84
2017/0280817 A1 * 10/2017 Hutchinson ..... A43C 11/14
2018/0055137 A1 * 3/2018 Fraser ..... A43B 5/02
2018/0110283 A1 * 4/2018 Brinkman ..... A43B 23/0295
2019/0037966 A1 * 2/2019 Aceves Tinajero ..... A43B 23/0235
2019/0313728 A1 * 10/2019 Berrian ..... A43B 23/0245
2019/0328075 A1 * 10/2019 Poulsen ..... A43B 23/0265

* cited by examiner

UPPER INCLUDING A KNITTED COMPONENT HAVING STRUCTURES WITH APERTURES EXTENDING FROM A SURFACE

CROSS-REFERENCE TO RELATED APPLICATIONS

This application claims the benefit of U.S. Provisional Application Ser. No. 62/411,633, filed Oct. 23, 2016, which is hereby incorporated by reference in its entirety.

BACKGROUND

Conventional articles of footwear generally include two primary elements: an upper and a sole structure. The upper is generally secured to the sole structure and may form a void within the article of footwear for comfortably and securely receiving a foot. The sole structure is generally secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and may form a ground-engaging portion of the sole structure that is formed from a durable and wear-resistant material.

The upper of the article of footwear generally extends over the instep and toe areas of the foot, along the medial and lateral sides of the foot, and around the heel area of the foot. Access to the void on the interior of the upper is generally provided by an ankle opening in a heel region of the footwear. A lacing system is often incorporated into the upper to adjust the fit of the upper, thereby facilitating entry and removal of the foot from the void within the upper. In addition, the upper may include a tongue that extends under the lacing system to enhance adjustability of the footwear, and the upper may incorporate a heel counter to limit movement of the heel.

BRIEF SUMMARY

In one aspect, the present disclosure is related to an upper for an article of footwear. The upper may include a knitted component with a first yarn, the first yarn forming a plurality of intermeshed loops of the knitted component. The upper may further include a surface formed by the plurality of intermeshed loops. The upper may further include a first structure at least partially forming a first aperture, the first structure extending from the surface, the first structure having a first end and a second end adjacent to the surface, and the first structure having a central portion extending from the first end to the second end. The first structure may include the first yarn.

In another aspect, the present disclosure relates to another embodiment of an upper for an article of footwear. The upper may include a knitted component having a first yarn, the first yarn forming a plurality of intermeshed loops of the knitted component. The upper may further include a first structure extending from the plurality of intermeshed loops, the first structure including the first yarn, and the first structure at least partially forming a first aperture. The upper may further include a second structure formed by a tensile strand, the second structure at least partially forming a second aperture being adjacent to the first aperture, and the tensile strand being inlaid within the plurality of intermeshed loops of the knitted component.

In another aspect, the present disclosure related to a method for manufacturing an upper for an article of footwear. The method may include knitting a knitted component on a knitting machine, the knitted component including a first yarn, the first yarn forming a plurality of intermeshed loops of the knitted component. A surface may be formed by the plurality of intermeshed loops. A first structure may extend from the surface, where the first structure at least partially forming a first aperture. The first structure may include the first yarn.

BRIEF DESCRIPTION OF THE DRAWINGS

The embodiments of the present disclosure may be better understood with reference to the following drawings and description. The components in the figures are not necessarily to scale, with emphasis instead being placed upon illustrating the principles of the present disclosure. Moreover, in the figures, like referenced numerals designate.

DETAILED DESCRIPTION

Figure 1:
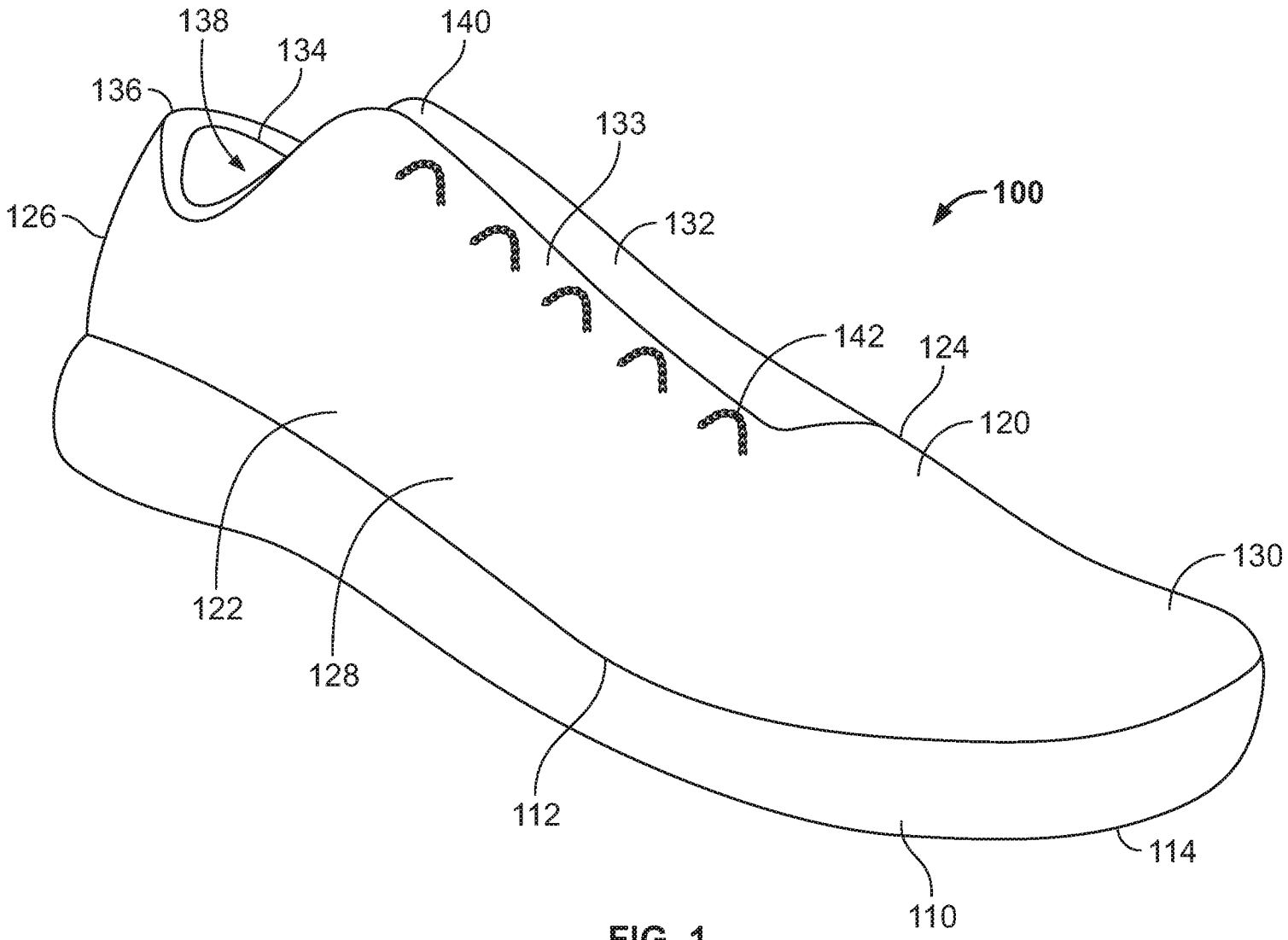
FIG. 1 shows an article of footwear with a first structure extending from a surface in accordance with the present disclosure.

Various aspects are described below with reference to the drawings in which like elements generally are identified by like numerals. The relationship and functioning of the various elements may better be understood by reference to the following description. However, aspects are not limited to those illustrated in the drawings or explicitly described below. It also should be understood that the drawings are not necessarily to scale, and in certain instances, details may have been omitted that are not necessary for an understanding of aspects disclosed herein.

Certain aspects of the present disclosure relate to uppers configured for use in an article of footwear. The uppers may be used in connection with any type of footwear. Illustrative, non-limiting examples of articles of footwear include a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. The uppers may also be incorporated into non-athletic footwear and shoes, such as dress shoes, loafers, and sandals.

With respect to FIG. 1, an example of an article of footwear 100 is generally depicted as including a sole structure (e.g., the sole 110) and an upper 120. The area of the shoe where the sole 110 joins the outer edge of the upper 120 may be referred to as the biteline 112. The upper 120 may be joined to the sole 110 in a fixed manner using any suitable technique, such as through the use of an adhesive, bonding, sewing, etc. In some embodiments, the sole 110 may include a midsole (not shown) and an outsole 114. In some embodiments, a separate sole 110 may be omitted and the upper 120 may comprise a lower surface that is configured to directly engage a ground surface.

The upper 120 may include a lateral side 122, a medial side 124, a heel region 126, a mid-foot region 128, and a toe region 130. The upper 120 may additionally include a throat 132 and an ankle opening 134, which may be surrounded by a collar 136. The upper 120 may define a void 138 of the article of footwear that is configured to receive and accommodate the foot of a user or wearer. The throat 132 may generally be disposed in the mid-foot region 128 of the upper 120. The mid-foot region 128 is depicted as a section of the upper 120 located between the heel region 126 and a toe region 130.

In FIG. 1, a tongue 140 is disposed in the throat 132 of the shoe, but the tongue 140 is an optional component. Although the tongue 140 depicted in FIG. 1 is a traditional tongue, the tongue 140, if included, may be any type of tongue, such as a gusseted tongue or a burrito tongue. If a tongue is not included, the lateral and medial sides of the throat 132 may be joined together, for example. The upper 120 may include at least one structure with an aperture 143 for receiving a lace as described in more detail below, a plurality of which are depicted in FIG. 1 as the first structures 142.

Figure 2:
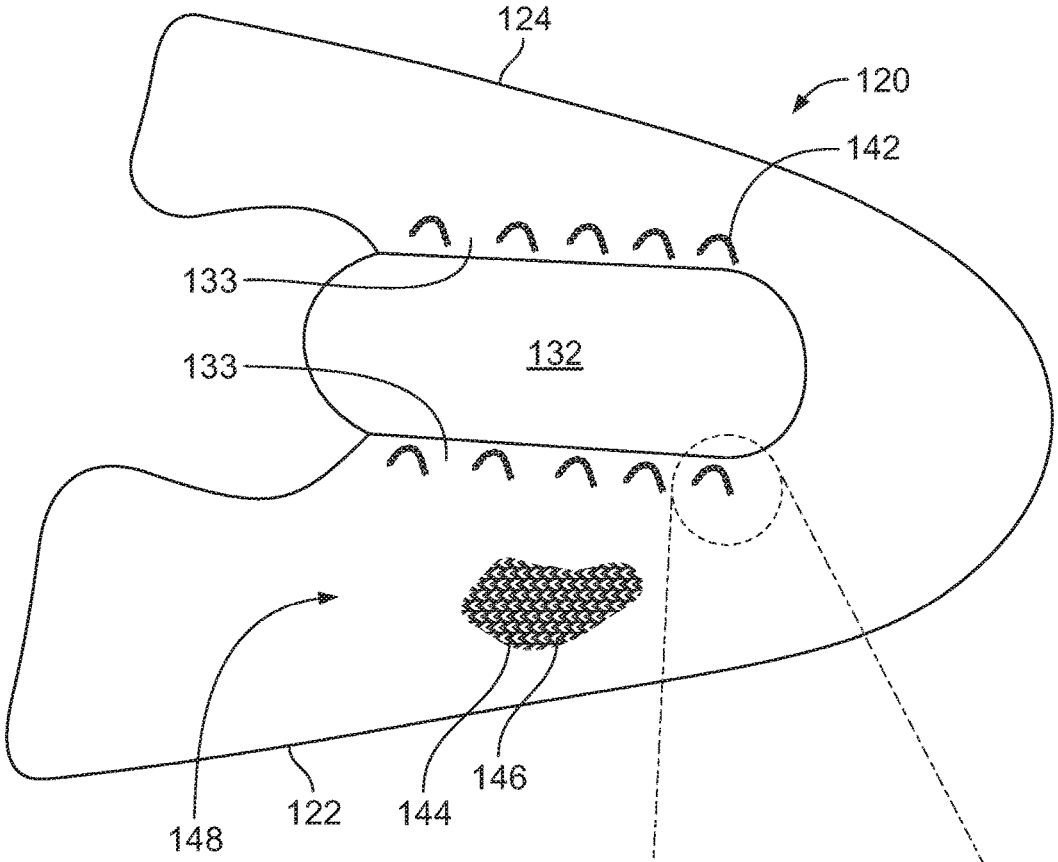
FIG. 2 shows the upper included in the article of footwear of FIG. 1 in isolation.

FIG. 2 shows the upper 120 in isolation (e.g., as it may appear jut after removal from a knitting machine). As shown, the upper 120 may be formed at least partially of a knitted component 144. For example, the upper 120 may be at least partially formed by a continuous and integral knitted component 144, and in some embodiments the knitted component 144 may substantially form the entirety of the upper 120. It is contemplated that the knitted component 144 may be manufactured as an integral one-piece element during a single process, such as a single weft knitting process (e.g., with a flat knitting machine or circular knitting machine), a single warp knitting process, or any other suitable knitting process. Alternatively, the knitted component 144 may be formed of a plurality of individual pieces (where each of the plurality of pieces may be knitted), where the individual pieces are assembled together (e.g., by sewing), after the knitting process.

The knitted component 144 may include one or more yarns. For example, a first yarn (which may refer to a single strand of yarn or multiple strands of yarns of the same type) may be formed primarily of polyester, which may provide suitable elasticity and comfort characteristics to the upper 120. A second yarn may be formed of another material. For example, the second yarn may include a material with a particular melting point (herein referred to as a "fusible material"), where the fusible material is configured to activate (e.g., at least partially melt) when subjected to a certain temperature during the manufacturing process to provide the knitted component 144 with particular properties. For example, the fusible material may include a melting temperature of about 150° C. or less (such as about 65° C. in one exemplary embodiment). When subjected to a temperature above the melting temperature, the fusible material may at least partially melt and flow and/or stick to surrounding yarns or other objects such that the material becomes affixed to (e.g., fused to) those surrounding yarns or other objects when cooled. This may provide the upper 120 with desirable stiffness and structure after a post-knitting steaming process, for example. It is contemplated that other yarns with other desirable properties (e.g., high rigidity or strength) may be included to enhance certain properties of the knitted component.

The above-described first yarn and/or the second yarn may form a plurality of intermeshed loops 146 of the knitted component. The intermeshed loops 146 may be formed when at least one of the first yarn and the second yarn are mechanically manipulated on a knitting machine, for example. The intermeshed loops 146 may form at least one surface of the knitted component 144, for example, an external surface 148 of the upper 120 in the embodiment of FIG. 2 (which is configured to face away from the void of the article of footwear). While not shown in this embodiment, it is contemplated that multiple layers of intermeshed loops 146 may be included in the knitted component 144, where each layer defines one or more surfaces of the knitted component 144.

In addition to the intermeshed loops 146, the knitted component 144 may include one or more structures forming lace apertures (herein depicted as the first structures 142 with first apertures 143) that extend from the surface 148 of the upper and are integrally formed with the surface 148 (e.g., on a knitted machine). The first structures 142 may extend from the surface 148 in any direction, and in a resting state may extend in a direction between about 10° and about 170°, such as from about 40° to about 140° (e.g., such as about 90°) with respect to a direction along a plane parallel to the surface 148. Such an orientation may be provided by a particular resilience of the first structures 142 due to a particular tension in the yarns forming the first structures, the particular material used when knitting, post-knit processing (e.g., heat-processing a fusible material in the first structures 142 while holding the first structures 142 in a desired orientation), the addition of non-knit support elements, etc. The first apertures 143 may be at least partially formed by the first structures 142 (i.e., the first aperture 143 may be formed by the first structure 142 and the surface 148, or may be fully formed by the first structures 142), and may have a diameter at least as large as the diameter of a shoelace (which may be, for example, about 4 mm). One or more of the first structures 142 may include a loop at least partially formed by the first yarn, where the first yarn may also form one or more of the intermeshed loops 146 of the knitted component. The first structures 142, in some embodiments, may be formed substantially of the first yarn, but it is also contemplated that other yarns may be included (such as, for example, the second yarn, and/or a separate yarn that does not form the intermeshed loops 146). In other embodiments, the first structures 142 may be formed of the second yarn with the fusible material, which may be advantageous for providing the first structures 142 with desirable stiffness and other structural characters after heat-processing (e.g., steaming), and may also ensure strands or intermeshed loops of the yarns forming the first structures 142 (and/or the intermeshed loops forming the surface 148) are held in place with respect to one-another.

Figure 3:
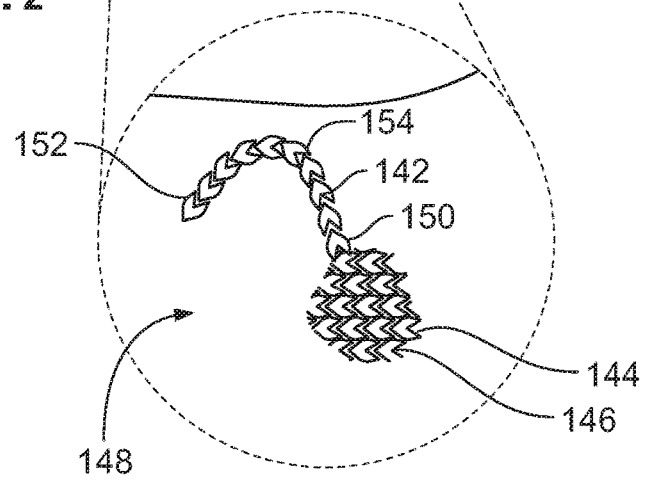
FIG. 3 shows a close-up view of a first structure of the upper of FIG. 2.

As shown in FIG. 3, the depicted first structure 142 of the knitted component 144 may include a first end 150, a second end 152, and a central portion 154 extending around the aperture 143 and from the first end 150 to the second end 152. The first end 150 may be adjacent to the point at which the yarn forming the first structure 142 begins to intermesh with the loops 146 from the surface 148 of the knitted component 144. As shown, the central portion 154 may be connected to the surface 148 through the ends of the first structure 142, but it may not be directly secured to the surface 148 through direct contact. In some exemplary embodiments (which are non-limiting), the central portion 154 of the first structure 142 may, when measured from the first end 150 to the second end 152 around the first structure 142, have a length of between about 2 mm to about 25 mm, such as from about 7 mm to about 15 mm (and more particularly about 11 mm), and a distance from the surface 148 to an apex of the first structure 142 may have a distance of about 1 mm to about 15 mm, such as about 3 mm to about 7 mm (and more particularly about 5 mm) when the first structure 142 is taught (and it is contemplated that these distances may be adjustable). The central portion 154 may be unsecured from the surface 148 (and therefore also the intermeshed loops 146 defining the surface 148) along its longitudinal length. As depicted, the central portion 154 may include its own intermeshed loops, which are separate from the intermeshed loops forming the surface 148. While in FIG. 3, the first structure 142 is depicted as having cross-sectional width of only one loop, in other exemplary embodiments, more (and potentially many more) loops may extend across the width of the first structure 142. For example, at least 3 loops, at least 5 loops, at least 10 loops, at least 20 loops, or more loops may extend across the width of the first structure 142. Alternatively, in other embodiments, the first structure 142 may include one or more yarns extending from the first end 150 to the second end 152 without intermeshed loops.

The first end 150 and the second end 152 may be secured to the surface 148. In some embodiments, for example, a fusible material may be included in yarn forming the surface 148 and/or the first structure 142. The fusible material may be activated (e.g., at least partially melted) when subjected to heat and then cooled to thereby affix the first end 150 and/or the second end 152. Additionally, or alternatively, the securement of the first end 150 and/or the second end 152 may be enhanced in another suitable manner, such as by sewing, by use of an adhesive, by tying, by mechanical clamping, etc. Advantageously, by enhancing the securement of at least at one of the first end 150 and the second end 152, the length of the central portion 154 of the first structure 142 can be controlled. For example, the length of the central portion 154 may be consistent and maintained even when subjected to a force (e.g., by pulling on a lace extending through the aperture 143 of the first structure 142). In other words, portions of the yarn that form the intermeshed loops 146 of the surface 148 may be prevented from being pulled into the aperture 143 formed by the first structure 142, and similarly, portions of the yarn forming the central portion 154 of the first structure 142 may be prevented from being pulled into the intermeshed loops 146 of the surface 148. Further, while the first structure 142 is generally described herein as having two secured ends, it is contemplated that at least one of the first end 150 and the second end 152 may remain unsecured such that the length of the central portion 154 of the first structure 142 is adjustable.

Advantageously, a shoelace or other object may be placed between the central portion 154 of the first structure 142 and the surface 148 such that a user can pull or otherwise provide a force to the first structure 142 to adjust the fit of the upper 120 around the user's foot. Referring to FIG. 1, the first structure 142 may be located in a throat area 133, which is adjacent to the throat 132 of the article of footwear 100. Further, as shown by FIG. 2, the first structures 142 may be located in the throat area 133 on multiple sides of the throat 132 (e.g., the lateral side 122 and the medial side 124). The upper 120 may be configured such that a lace (not shown) may extend in a manner such that it alternates between first structures 142 on alternate sides of the throat 132 in a criss-cross pattern. By pulling on the lace, the upper 120 can be tightened with respect to the throat 132.

Figure 4:
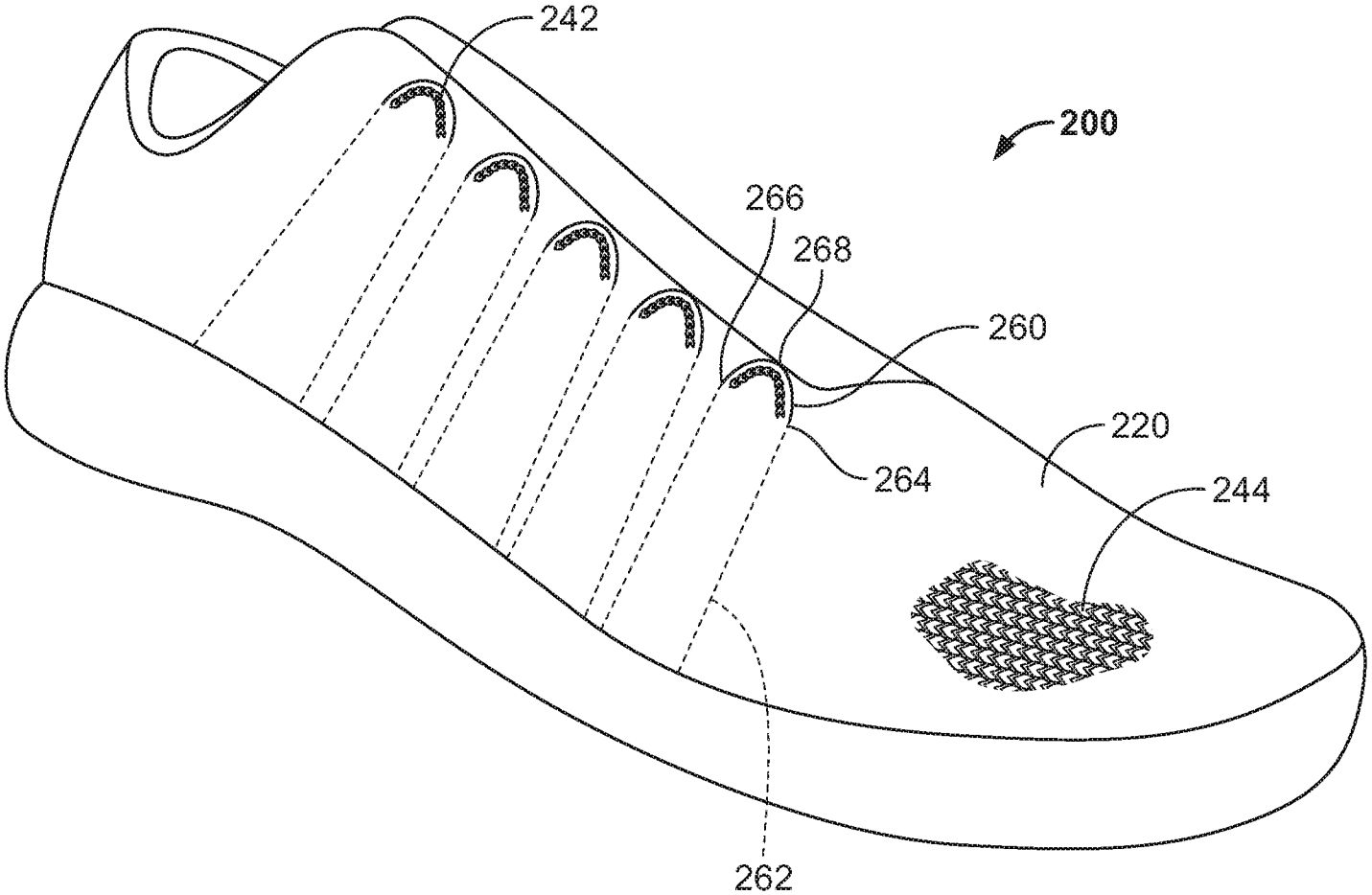
FIG. 4 shows an upper for an article of footwear with tensile strands in accordance with the present disclosure.
Figure 5:
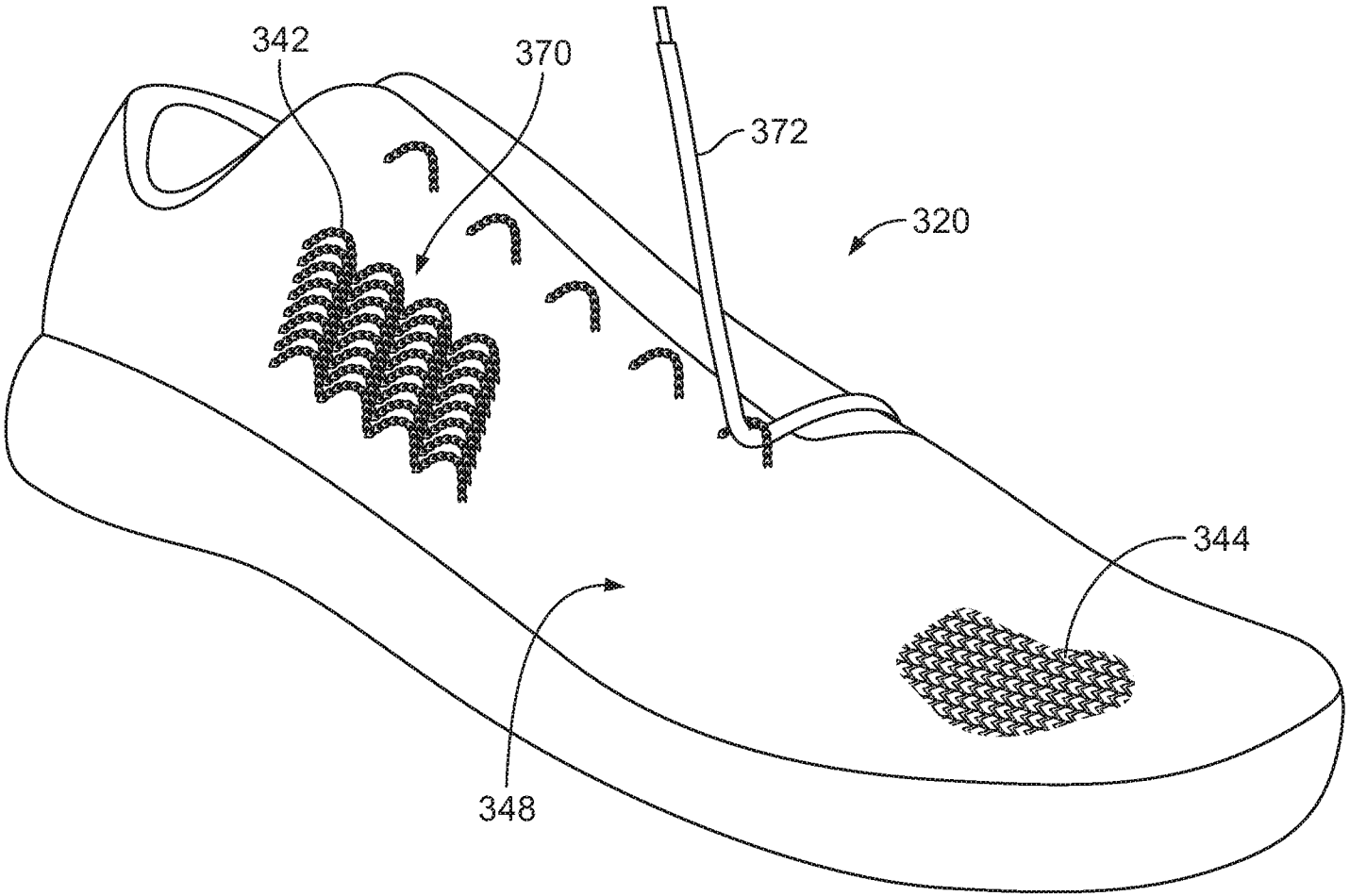
FIG. 5 shows an upper with loops forming a cushioning region in accordance with the present disclosure.

Referring to FIG. 4, an article of footwear 200 may have an upper 220 with first apertures 243 formed by the depicted first structures 242 (similar to as described above with regard to first structures 142) and additionally with one or more second structures 260 (with second apertures 261) formed by one or more tensile strands 262. The tensile strands 262 are an optional component and may form lace apertures (e.g., an aperture extending through the apertures 261 of the second structures 260) to receive a lace or another fastening element (see, e.g., the lace 372 shown in FIG. 5—though other fastening elements, such as cable tensioning systems, Velcro or other straps, etc. may be used). A tensile strand may be a yarn, a cable, a rope, or any other type of strand or elongated element. A tensile strand may be flexible, but it also may have a substantially fixed length measured from a first end to a second end. As such, the tensile strand can be substantially inelastic. The one or more tensile strands 262 may extend across and/or along the upper 220 in any direction. The tensile strands may limit the stretch of the knitted component. The tensile strands 262 may preferably be inlaid within the intermeshed loops of the knitted component 244, but it is contemplated that portions of the tensile strands may be exposed from the knitted component. For example, portions of the tensile strands may extend out of the knitted component in the throat region to form the second structures 260. See, for example, U.S. Patent Application Publication No. 2015/0359290, U.S. Patent Application Publication No. 2014/0237861, and U.S. Pat. No. 9,145,629, which are incorporated into the present application in their entirety. When the knitted component 244 includes multiple layers, the tensile strands 262 may be placed between the layers of the knitted component 244, and/or may be incorporated primarily into any one of the layers at least at one particular location.

As shown in FIG. 4, the second apertures 261 of the second structures 260 may be adjacent to the apertures 243 of the first structures 242. The second structures 260 may have a first end 264, a second end 266, and a central portion 268 that has a length approximately equal to the length of the central portion of the first structure 242 (although, for clarity of the illustration, the second structures 260 are illustrated as slightly larger). Advantageously, when a lace is received by the aperture 243 of the first structure 242, it may also be received by the aperture 261 of the second structure 260 formed by the tensile strand 262 at about the same location. That is, when both apertures receive the fastening element, the location of engagement (e.g., contact) of the fastening element with the first structure 242 may be about 5 mm or less (such as less than 2.5 mm or less, such as about 1 mm) from where the fastening element engages the second structure 260. The second structure 260 may enhance the properties associated with the upper 220 by, for example, providing a combined lace aperture (e.g., the combination of the first aperture 243 and the second aperture 261 of the first structure 242 and the second structure 260, respectively) with desirable strength, stretch resistance, or the like.

It is contemplated that the first structures 242 and the second structures 260 may have different properties. For example, the length of the central portion of the first structures 242 may be less than the length of the central portion of the second structures 260 (as shown). Further, the first structures 242 may be more elastic (and therefore less stretch-resistant) than the second structures 260. Advantageously, in this embodiment, when an initial force is provided on the respective apertures of the first structures 242 and the second structures 260, the first structures 242 may become taught first. The relatively elastic first structures 242 provide a relatively precise level of tightening at this stage. However, once the central portion of the first structures 242 is stretched a certain amount, the larger second structures 260 may also become taught. The second structures 260, which may be less elastic, may then stop the first structures 242 from stretching, thereby providing a lockout feature of the lacing system. The second structures 260 may additionally be provided with a relatively high strength to prevent the first structures 242 and/or the second structures 260 from becoming stretched to their breaking point.

Structures extending from the surface of a knitted component may additionally or alternatively be used for functions other than for receiving a lace. For example, referring to FIG. 5, an upper 320 may include a knitted component 344 with a plurality of first structures 342 in a first area 370. The first structures 342 may have a structure similar to the first structures 142 as described above (with reference to FIG. 1-FIG. 3). The first structures 342 may be lofted such that they form an area where the knitted component 344 has three-dimensional ("3D") properties configured to provide certain functional and/or aesthetic functions. For example, the first structures 342 may provide cushioning (e.g., at a cushioning area or first area 370), particularly when the yarn(s) forming the first structures 342 are formed of a relatively soft material that is comfortable to the touch (e.g., polyester). To enhance cushioning, the first structures 342 may be placed in relatively close proximity. That is, at their respective basis, the first structures 342 (i.e., at least two of them) may be 1 cm or less apart, such as about 5 mm apart or less, 2.5 mm apart or less, or even 1 mm apart or less. The first area 370 with the first structures 342 is depicted as being located on the external surface 348 of the upper 320, but loops may additionally or alternatively extend from another surface (such as an internal surface), which may be advantageous for providing cushioning or other features within a void of the article of footwear. In some embodiments, the structures may form loops for other functions (e.g., to form a tab element as taught in U.S. Provisional Patent Ser. No. 62/421,850, which is hereby incorporated by reference in its entirety).

Figure 6:
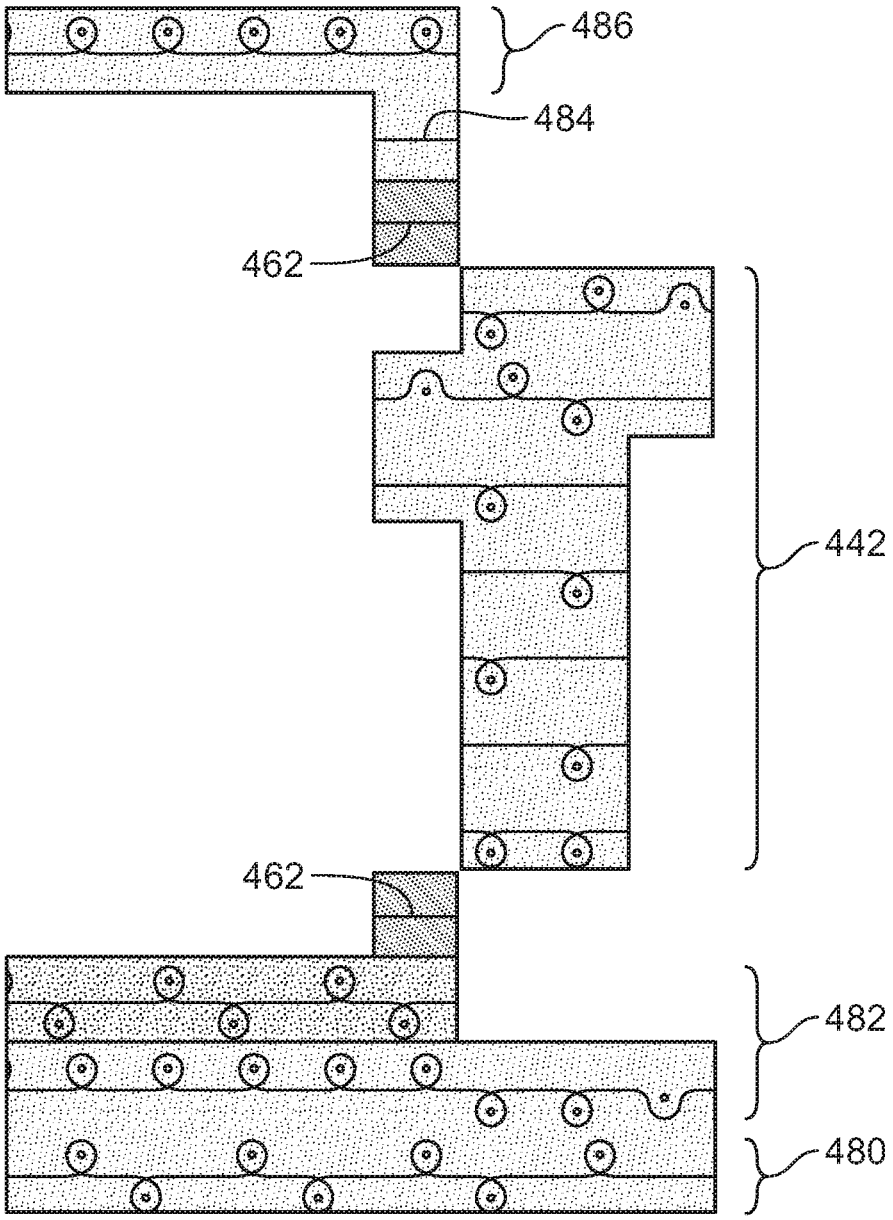
FIG. 6 shows an example of a knit diagram of one sequence for knitting a knitted component with a loop in accordance with the present disclosure.

FIG. 6 shows an example of a knit diagram (which is not limiting and is for illustrative purposes only) of one sequence for knitting a knitted component with a structure in accordance with the present disclosure. It is noted that, where only partial sequences are depicted in FIG. 6, those partial sequences may be repeated. Further, the entirety of the width of FIG. 6 may be considered a partial or full sequence for a particular course. Referring to FIG. 6, a first zone 480 may include a 1×1 interlocked loop structure including a first yarn (which may refer to a particular, continuous piece or end of yarn). A second zone 482 may include one or more passes of the loop structure as represented by the diagram near an end of a first structure 442, and a second yarn in the second zone 482 may be provided with a fusible material, for example (e.g., for securing the end of the first structure 442). Additionally or alternatively, the first yarn may comprise a fusible material. As represented by the diagram, the first structure 442 (which may correspond with the first structure 142 of FIG. 1) may include several passes of the knitting machine, and may include passes only on one bed or on both beds. The number of passes may determine the length of the first structure 442, and the number of passes when forming the first structure 442 may be optimized for a particular central portion length. An inlaid strand 462 (which may correspond with the tensile strand 262 of FIG. 4) may be inlaid on one or both (as shown) ends of the first structure 442. One or more float yarns 484 (which may include the first yarn) may be included adjacent to the inlaid strand 462. The float yarns 484 may be advantageous for ease of manufacturing and for providing additional fusable material near at least one end of the first structure 442, for example. A third zone 486 may then be formed with any suitable knit structure, such as a single jersey knit structure of the first yarn (as shown), which may be repeated as necessarily.

The first structure 442 is shown as being knitted on two needles of the knitting machine. However, it is contemplated that the first structure 442 may be knitted on more (or less) than two needles to give the central portion of the first structure 442 a particular width. For example, a first structure 442 knitted generally on four needles may be wider than the depicted first structure 442 in FIG. 6. It is also contemplated that the width of the first structure 442 may change along its length, such that the first structure 442 may have first and second widths, where the first width is greater than the second width. Also, while the first structure 442 is depicted as including only one yarn, a second yarn (or additional yarns) may be included, particularly when it is advantageous to provide the first structure 442 with characteristics of multiple yarn types.

All of the structures and methods disclosed and claimed herein can be made and executed without undue experimentation in light of the present disclosure. While this disclosure may be embodied in many different forms, there are described in detail herein specific aspects of the disclosure. The present disclosure is an exemplification of the principles of the disclosure and is not intended to limit the disclosure to the particular aspects illustrated. In addition, unless expressly stated to the contrary, use of the term "a" is intended to include "at least one" or "one or more." For example, "a yarn" is intended to include "at least one yarn" or "one or more yarns."

Any ranges given either in absolute terms or in approximate terms are intended to encompass both, and any definitions used herein are intended to be clarifying and not limiting. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the disclosure and without diminishing its intended advantages. It is therefore intended that such changes and modifications be covered by the appended claims.

We claim:

1. An upper for an article of footwear, the upper comprising:

a knitted component including a first yarn, the first yarn forming a plurality of courses of a base layer of the knitted component;

a surface of the base layer formed by a plurality of intermeshed loops included in the plurality of courses; and a first structure extending from the surface of the base layer such that an aperture is located between the first structure and the base layer, the first structure having a first end and a second end adjacent to the surface and secured to the base layer via a common yarn, and the first structure having a central portion extending from the first end to the second end, wherein the central portion of the first structure comprises at least one of a single jersey wale and course that is separate from the plurality of courses of the base layer.

2. The upper of claim 1, wherein the aperture formed by the first structure is located in a throat area of the upper for receiving a fastening element of the article of footwear.

3. The upper of claim 1, further comprising a tensile strand, wherein the tensile strand forms a second structure at least partially forming a second aperture, the second aperture being adjacent to the first aperture of the first structure such that a fastening element can pass through the first aperture and the second aperture.

4. The upper of claim 3, wherein the tensile strand is inlaid within intermeshed loops of the knitted component.

5. The upper of claim 1, wherein the first yarn includes a fusible material configured to affix at least one of the first end and the second end of the first structure with respect to the surface.

6. The upper of claim 1, wherein the knitted component includes a second yarn, the second yarn including a fusible material configured to affix the first yarn with respect to the second yarn.

7. The upper of claim 1, wherein the first structure extends from the surface in a direction between 30° and 170° with respect to a direction along a plane parallel to the surface when the first structure is in a resting state.

8. The upper of claim 1, wherein the first structure includes a plurality of second intermeshed loops of the first yarn, the second intermeshed loops being separate from the first plurality of intermeshed loops forming the surface.

9. The upper of claim 1, wherein the first structure is one of a plurality of first structures forming a cushioning area, and wherein a base of one of the first structures is about 2.5 mm or less from the base of another of the first structures in the cushioning area.

10. An upper for an article of footwear, the upper comprising:

a knitted component including a first yarn, the first yarn forming a plurality of intermeshed loops of a knitted base portion the knitted component;

a first structure having a single jersey knit wale, the first structure extending from the plurality of intermeshed loops, the first structure including the first yarn, and a first aperture being defined between the first structure and the knitted base portion; and a second structure formed by a tensile strand, the second structure at least partially forming a second aperture being adjacent to the first aperture, and the tensile strand being inlaid within the plurality of intermeshed loops of the knitted component.

11. The upper of claim 10, wherein the first aperture and the second aperture are located in a throat area of the upper.

12. The upper of claim 10, wherein the first aperture and the second aperture are both configured to receive a fastening element of the article of footwear.

13. The upper of claim 12, wherein the first aperture and the second aperture are positioned for communication with the fastening element at about the same location.

14. The upper of claim 10, wherein the first yarn includes a fusible material configured to affix an end of the first structure with respect to an intermeshed loop.

15. The upper of claim 10, wherein the knitted component includes a second yarn, the second yarn including a fusible material configured to affix the first yarn with respect to the second yarn.

16. The upper of claim 10, wherein the first structure has a central portion with a length between about 7 mm and about 15 mm.

17. The upper of claim 10, wherein the first structure includes a plurality of second intermeshed loops of the first yarn.

* * * * *